US006085914A

United States Patent [19]

Tobaccowala et al.

[11] Patent Number: 6,085,914

[45] Date of Patent: Jul. 11, 2000

[54] SOFT ARTICLE SORTING SYSTEM

[75] Inventors: Safdarali Tobaccowala; Fatehali Mohamed, both of Toronto, Canada

[73] Assignee: H. Salb International, Toronto, Canada

[21] Appl. No.: 09/275,469

[22] Filed: Mar. 24, 1999

[51] Int. Cl.[7] ..... B07C 7/04; B03B 1/00; B02C 9/00

[52] U.S. Cl. ..... 209/702; 209/3.3; 209/3; 209/937; 100/91

[58] Field of Search ..... 209/937, 3, 3.3, 209/10, 1, 702, 703, 576, 577; 100/91; 194/208, 209

[56] References Cited

U.S. PATENT DOCUMENTS

| | | | |
|---|---|---|---|
| 2,490,071 | 12/1949 | Mackechnie, Jr. . | |
| 2,589,561 | 3/1952 | Mackechnie, Jr. . | |
| 2,990,965 | 7/1961 | Smoll et al. . | |
| 3,198,351 | 8/1965 | Paglee . | |
| 3,272,353 | 9/1966 | Wilder . | |
| 3,397,800 | 8/1968 | Shaw . | |
| 3,406,843 | 10/1968 | Lasbrey et al. . | |
| 3,448,869 | 6/1969 | Braun et al. . | |
| 3,642,117 | 2/1972 | Burt . | |
| 3,785,474 | 1/1974 | Nakamoto | 198/38 |
| 3,955,678 | 5/1976 | Moyer . | |
| 4,036,365 | 7/1977 | Rosenfeld | 209/576 |
| 4,136,778 | 1/1979 | Wortman et al. | 209/576 |
| 4,646,978 | 3/1987 | Johnson et al. | 241/24 |
| 4,762,280 | 8/1988 | Prisco et al. | 241/3 |
| 4,907,699 | 3/1990 | Butcher et al. . | |
| 4,991,719 | 2/1991 | Butcher et al. | 209/3.3 |
| 5,072,822 | 12/1991 | Smith . | |
| 5,141,094 | 8/1992 | Speckhart et al. . | |
| 5,168,645 | 12/1992 | Robin et al. | 198/465.4 |
| 5,238,116 | 8/1993 | Santicchi . | |
| 5,419,439 | 5/1995 | Branch | 209/3.3 |
| 5,435,445 | 7/1995 | Dellinger, Jr. et al. | 209/576 |
| 5,620,102 | 4/1997 | Finch, Jr. . | |

*Primary Examiner*—Donald P. Walsh
*Assistant Examiner*—Daniel K Schlak
*Attorney, Agent, or Firm*—L. Anne Kinsman

[57] ABSTRACT

A garment sorter for semi-automating the sorting of bulk used clothing, and a method of sorting such clothing. Bales of clothing are uncompressed, and single articles of clothing are fed to an operator. Equally, the system can be used for sorting loose clothing. The operator identifies the article verbally, or by keypad entry. Voice recognition software, or other appropriate application software, recognizes the identification, and associates an address with the identified article. The article is then fed to a compacting device that ensures that it is retained within a certain length along a transfer conveyor. The compacted article is then transported to transfer station where a pneumatic pusher, under the control of a PLC, pushes the identified article off the conveyor into a bin, or secondary sort system.

20 Claims, 7 Drawing Sheets

SOFT ARTICLE SORTING SYSTEM

FIELD OF THE INVENTION

The present invention relates to a system for sorting articles. In particular, the present invention relates to an system for sorting soft articles, such as clothing and other non-uniform textile articles.

BACKGROUND OF THE INVENTION

In the garment industry, the collection and recycling of used clothing has become commonplace. Donated clothing is compressed into large bales and sold to recyclers according to weight. The recyclers then sort and grade the clothing according to a variety of factors, such as color, material, and type of garment. Once sorted, the clothing can be sold to specific markets, both domestic and foreign.

Generally, the sorting and grading is done by hand in a time consuming and labour intensive manual operation. The bales of highly compressed clothing, each weighing approximately one thousand to two thousand pounds, and occupying a meter and half cube, are opened. A sorter then manually lifts each article of clothing from the bale, identifies it, and throws it into an appropriate bin located in proximity to the sorting station. In a typical sorting operation, a sorter can have from twenty to sixty separate bins in which to sort and grade clothing. In a typical day each sorter can manually sort approximately 3000 lbs., or three bales, of clothing. As will be appreciated, this method of sorting is extremely expensive. Numerous sorters are required, as well as a large floor space to accommodate the sorting stations. In addition, workers are prone to repetitive strain injuries from tossing heavy clothing across large distances. It will be further appreciated that the used clothing industry is becoming increasingly competitive, and operates on very small profit margins.

It is, therefore, desirable to automate the sorting operation. However, the nature of used clothing makes automation particularly difficult and ill-adapted to prior art sorting systems. The bales of clothing received by a recycler can include everything from blankets to silk scarves to shoes. Clothing, by its very nature, is soft and pliable, difficult to handle on a typical conveyor system and to separate adequately for identification.

In the prior art, it is well known to sort items such as rigid packages, particularly in the postal and inventory management fields. Typically, an identifier, such as a bar code or other readable indicia, is stamped on the item. The item is fed to a conveyor system, the identifier is read, and the item is conveyed to a predetermined location. Some form of pusher is then employed to route the package into a sorting bin, or onto a further conveyor. An example of such a system can be found in U.S. Pat. No. 3,642,117 to Burt. Such systems are not suitable for sorting loose clothing since it is difficult, if not impossible, to mark clothing, and it tends to bunch up thereby obscuring any applied indicia. In addition, such marking can damage clothing and would add an undesirable intermediary step to the sorting process.

The prior art is also replete with systems for sorting clothing hung on hangers, particularly in the dry cleaning industry. Such systems are used in large automated dry cleaning establishments. Examples of such systems can be found in U.S. Pat. No. 5,238,116 to Santicchi, and U.S. Pat. No. 5,419,439 to Branch. These systems also require a unique identifier to be applied to the article, typically a tag attached to the hanger or garment, and are therefore inapplicable to sorting loose clothing.

It is, therefore, desirable to provide a novel sorting apparatus for bulk articles, particularly soft non-uniform articles, such as clothing and other textiles.

SUMMARY OF THE INVENTION

In a first embodiment of the present invention, there is provided a sorting system for sorting non-uniform articles, comprising:

an identification station wherein identification information is associated with an article, said article being one of a plurality of non-uniform articles, said identification station including a compacting device for compacting said identified article to a predetermined length;

a conveyor for receiving said identified article from said identification station;

a plurality of transfer stations dispersed along the length of said conveyor, wherein said identification information determines at which of said plurality of transfer stations said identified article is to be transferred, and including means to transfer said identified article.

In a preferred embodiment, the system of the present invention is a garment sorter for semi-automating the sorting of bulk used clothing. Bales of clothing are uncompressed, and single articles of clothing are fed to an operator. Equally, the system can be used for sorting loose clothing. The operator identifies the article verbally, or by keypad entry. Voice recognition software, or other appropriate application software, recognizes the identification, and associates an address with the identified article. The article is then fed to a compacting device that ensures that it is retained within a certain length along a transfer conveyor. The compacted article is then transported to transfer station where a pneumatic pusher, under the control of a PLC, pushes the identified article off the conveyor into a bin, or secondary sort system.

In a further aspect of the present invention, there is provided a method of sorting soft, non-uniform articles supplied as a compressed bale, comprising the steps of:

(i) separating a compressed bale into a stream of articles;

(ii) feeding the separated articles to an identification station;

(iii) associating identification information with each said separated article;

(iv) compacting the identified article to a predetermined length;

(v) transporting the compacted article to a transfer station determined by the associated identification information; and (vi) transferring the compacted article at the determined transfer station to sort the compacted article.

BRIEF DESCRIPTION OF THE DRAWINGS

Preferred embodiments of the present invention will now be described, by way of example only, with reference to the attached Figures, in which.

DETAILED DESCRIPTION

Figure 1:
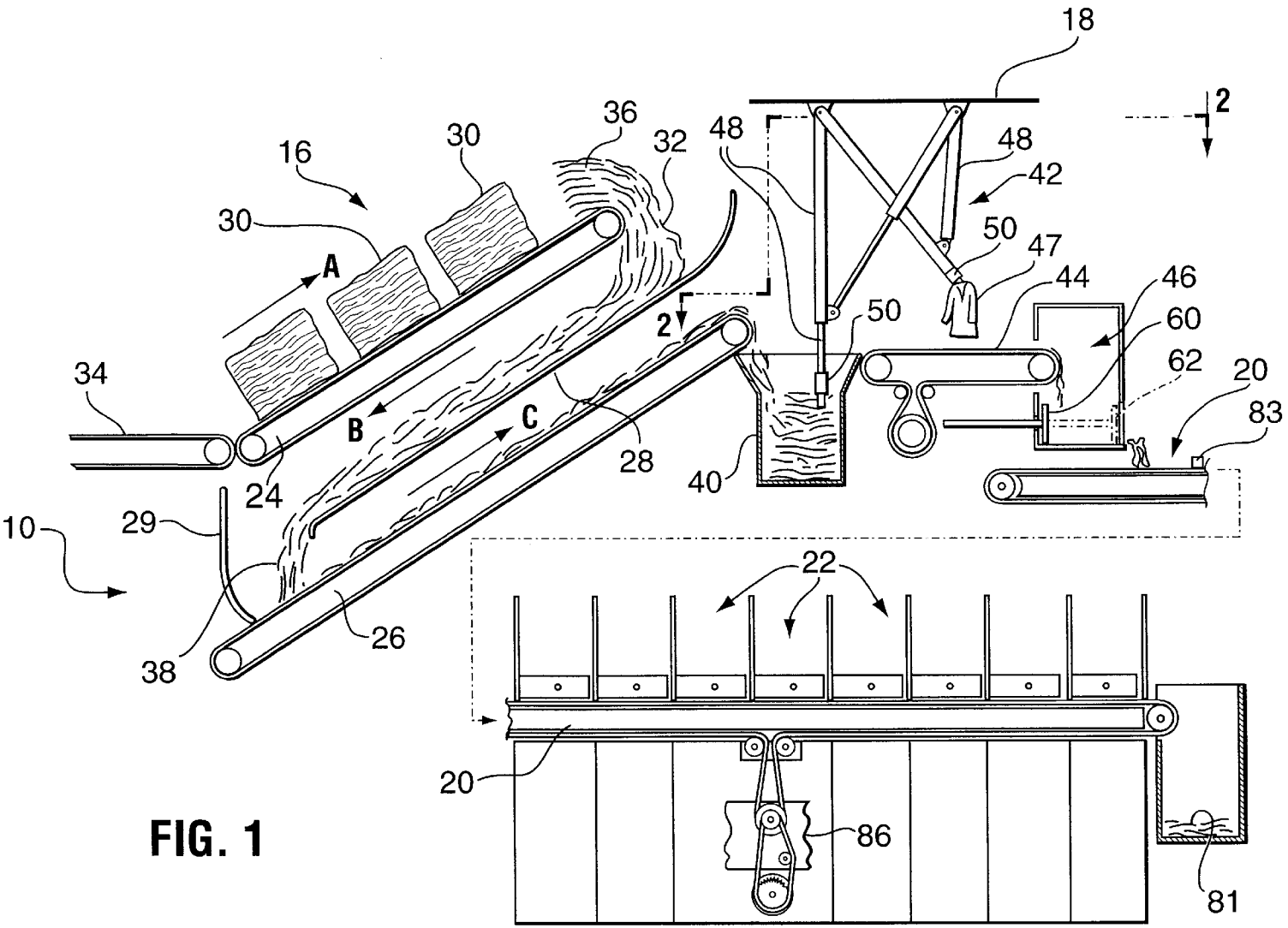
FIG. 1 is a schematic side view of sorting system according to an embodiment of the present invention.

An embodiment of the sorting system of the present invention is shown in FIG. 1, and generally designated at reference numeral 10. System 10 is adapted to sort articles of differing sizes, shapes and textures, especially textile articles that are supplied as a compressed bale, such as used clothing and the like. The following description will describe the construction and operation of embodiments of the present invention as they are used to sort used clothing. However, the present invention is not limited to the sorting of used clothing, and is fully intended to have application in other industries where conventional automated or semi-automated sorting systems are inappropriate, particularly those applications directed to the sorting of soft, non-uniform articles.

System 10 generally consists of a feed station 16, an identification station 18, a transporter 20 and plurality of transfer stations 22. In the illustrated embodiment, feed station 16 consists of inclined conveyors 24 and 26, separated by a slide chute 28. A backstop 29 is positioned adjacent the lower portion of conveyor 26 to prevent articles from falling off conveyor 26. Conveyors 24 and 26 can be powered by any suitable power source, as is well known to those of skill in the art. Conveyor 24 is sized to receive bales 30 of compressed clothing. Slide chute 28 and conveyor 26 are similarly sized to receive a stream 32 of separated articles. Conveyors 24 and 26, and slide chute 28 are each inclined at an angle in the range of approximately 30°–45°, and the bales 30 and stream 32 travel through separation station 16 as indicated by the arrows A, B and C, respectively.

In a preferred embodiment, bales 30 are each formed of bulk, unsorted clothing compressed into a generally cubical shape, and bound with a binding material, such as plastic wrap or strapping. Conventional bales weigh approximately one thousand pounds and are conveyed to system 10 by a feed conveyor 34, as shown, a forklift, or other suitable transport system. Prior to loading onto conveyor 24, bales 30 are opened by removing the binding material. Conveyor 24 transports the opened bales 30, in the direction of arrow A, to an upper edge 36. As the bales 30 reach upper edge 36 they begin to topple off conveyor 24 in slices. This separates and decompresses the bales 30 into stream 32. Stream 32 then slides down slide chute 28, in the direction of arrow B. When stream 32 reaches a bottom edge 38, it falls onto conveyor 26, moving in the direction of arrow C. The speed of conveyor 28 is chosen such that stream 32 is substantially a stream of separate, discrete articles which is conveyed to identification station 18. As will be apparent to those of skill in the art, multiple feed stations 16 can operate to convey articles to identification station 18. While the illustrated feed station 16 serves to separate baled articles, it is also fully within the contemplation of the present inventors that non-separating feed stations, such as simple conveyors or manual loading, can be used in system 10.

Figure 2:
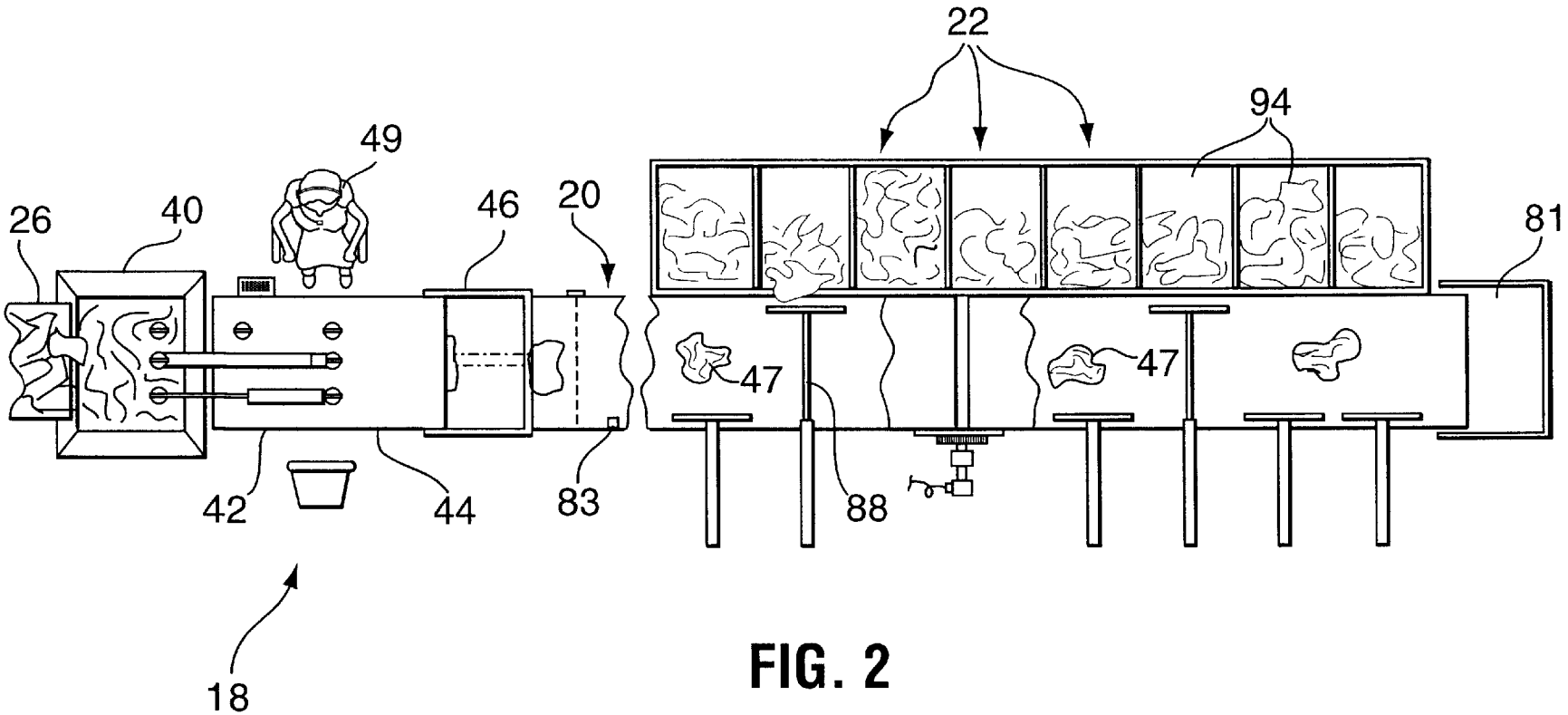
FIG. 2 is a schematic plan view of the system of FIG. 1 taken along arrows 2—2.
Figure 3:
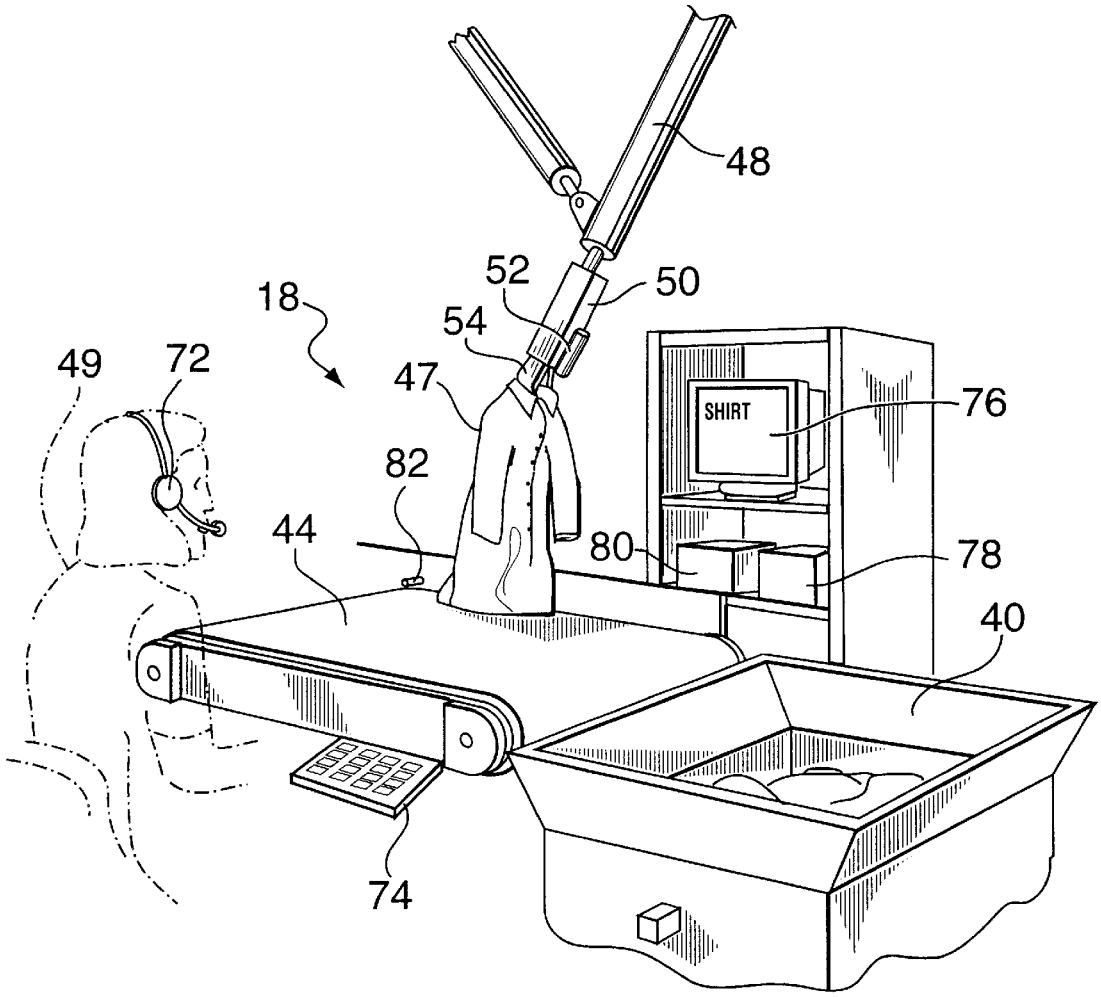
FIG. 3 is a perspective view of an identification station according to the embodiment of FIG. 1.

Referring to FIGS. 1, 2 and 3, identification station 18 generally consists of a feed bin 40, a selection means, such as grippers 42, an identification conveyor 44 and a compacting device 46. An operator 49 sits or stands facing identification conveyor 44. Feed bin 40 is a container into which substantially separated articles 47 of clothing are loosely fed by conveyor 26 of separation station 16. Grippers 42 are positioned above feed bin 40 and identification conveyor 44. Grippers 42 are robotically controlled and include retractable arms 48 and gripper arms 50. In an alternative embodiment, grippers 42 can be omitted, and articles of clothing can be selected manually from feed bin 40.

Figure 4:
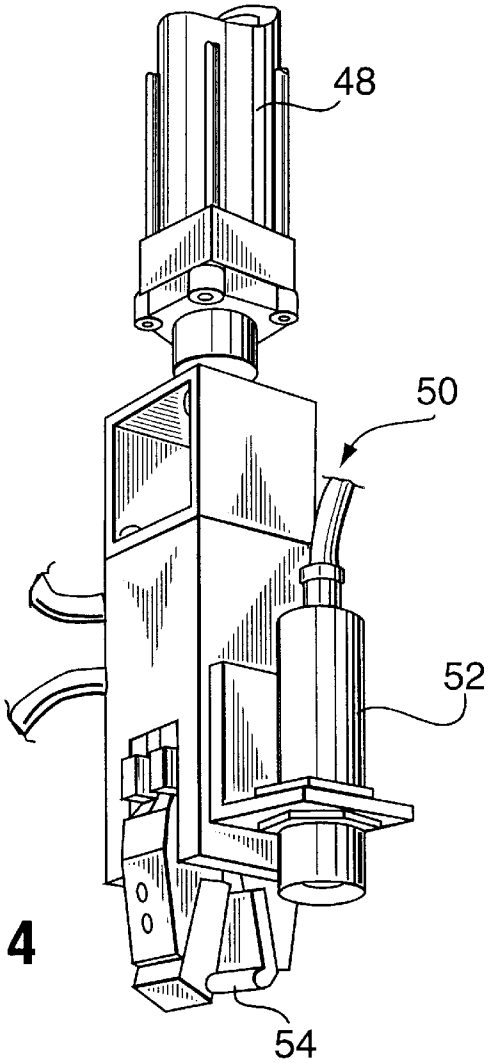
FIG. 4 is a perspective view of a gripper arm according to the embodiment of FIG. 1.

Gripper arm 42 can be seen in greater detail in FIG. 4. Gripper arm 50 includes a proximity sensor 52 for sensing an article of clothing, and a gripper jaw 54 that can grip one article of clothing at a time. In a currently preferred embodiment, gripper arm 42 is commercially available Festo-DNC-32-660 double acting cylinder, while proximity sensor 52 can be any suitable proximity sensor, such as a Honeywell 972CP15TMA13N-L.

Referring to FIGS. 2 and 5, compacting device 46 is shown in greater detail. Compacting device 46 consists of a box 56, open at one side, into which an article 47 can drop from identification conveyor 44. A pneumatically powered pusher 58 is adapted to reciprocate between a loading position 60 and an unloading position 62, shown in dashed lines. In loading position 60, a front face 64 of pusher 58 is substantially flush with the rear of box 56. In unloading position 62, front face 64 is substantially coplanar with the open side of box 56. In a preferred embodiment, box 56 is approximately twenty inches square at its base.

Operator 49 is equipped with an input system for controlling the identification of, and ultimately the sorting of, articles 47. In a presently preferred embodiment, shown in detail in FIG. 3, input system consists of a headset 72, an optional keypad 74, and a display 76. Headset 72, keypad 74 and display 76 are all attached to a conventional computer system 78 running application software, such as voice recognition software and interface software. The interface software communicates between the input system and a programmable logic controller (PLC) 80, such as an Omron CQML/41 PLC. In addition, at least one optical sensor 82 is provided at the downstream end of conveyor 44 for sensing the passage of an article.

The operation of system 10 at identification station 18 will now be described with reference to FIGS. 1–5*a*. Separated clothing is fed from separation station 16 into feed bin 40. Gripper 42 is positioned over feed bin 40, and retractable arm 48 is extended such that gripper arm 50 is brought into proximity with the loose clothing. When proximity sensor 52 senses article 47, gripper jaws 54 are clamped on article 47, retractable arm 48 is retracted, and gripper 42 swings over identification conveyor 44 and releases article 47 thereon. As article 47 is being deposited on conveyor 44, operator 49 identifies the article according to predetermined sorting and grading criteria. In a presently preferred embodiment, operator 49 identifies article 47 verbally by speaking into headset 72. Suitable voice recognition software recognizes the voice command. The computer system 78 then processes the identification, and relays the identification information to the PLC 80. Alternatively, operator 49 can input identification information directly via keypad 74. If the operator is unable to identify article 47, a "cancel"

command can be entered. Articles that are not identified, or for which no identification is provided, will be transferred to a reject bin 81, at the end of conveyor 22, as will be further explained below.

If a recognized identification command is entered by the operator, either verbally or manually, the identification and sort criteria for article 47 are provided to PLC 80 which controls the sort operation as will be further described below. It is expected that an operator can identify approximately forty articles per minute, therefore, in a preferred embodiment, grippers 42 will deliver an article to identification conveyor 44 every 1.5 s.

Once identified, article 47 is conveyed to compacting device 46. As article 47 reaches the downstream end of conveyor 44, it passes sensor 82 which logs its passage into the compacting device 46, and relays this information to the PLC 80. PLC 80 then associates an address with the article with the previously entered identification information.

Figure 5A:
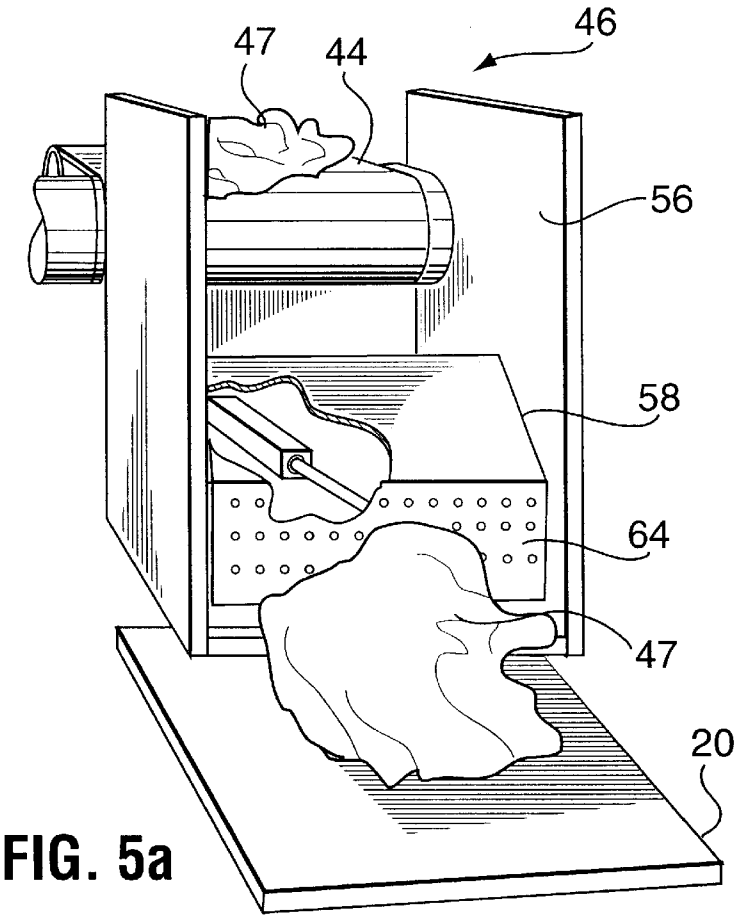
FIG. 5*a* is a perspective view of a compacting device, viewed from below the identification station, according to the embodiment of FIG. 1.

Referring to FIG. 5*a,* the function of compacting device 46 is to compact the article into no more than a predetermined space such that it does not trail along the length of transporter 20. This permits the non-uniform articles 47 to be substantially uniform in length, as measured along the length of conveyor 20. The length into which the articles 47 are compacted is determined by the width of the sorting bins into which the articles are to be deposited further down line. In a presently preferred embodiment, the above object is achieved by compacting article 47 in box 56, and ejecting the compacted article 47 from box 56 by advancing pusher 58. Pusher 58 is controlled by the signal from sensor 82, which indicates when article 47 has progressed beyond conveyor 44.

Figure 5B:
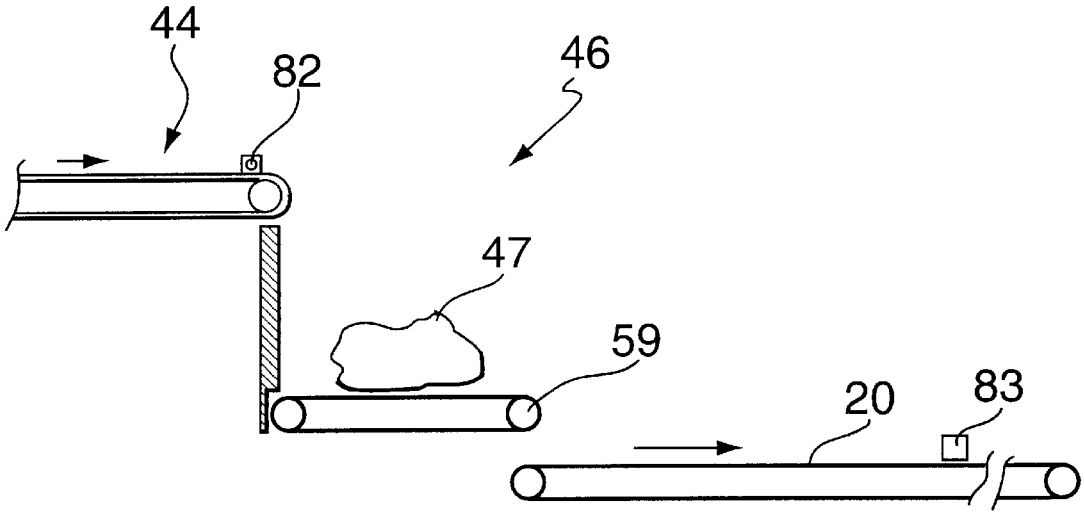
FIG. 5*b* is a side view of a compacting device according to a further embodiment of the present invention.

An alternative embodiment of compacting device 46 is shown in FIG. 5*b.* Pusher 58 is replaced by an on-off conveyor 59. After article 47 is identified at identification station 18, it is transported, by conveyor 44, past sensor 82 and falls on stationary conveyor 59. Sensor 82 signals PLC 80 that article 47 has passed onto conveyor 59, and PLC 80 operates conveyor 59 for approximately 0.4 s. to eject article 47 onto transporter 20. As will be apparent to those skilled in the art, article 47 drops onto conveyor 59 in a compacted bundle, which is then transferred to transporter 20. This embodiment of compacting device 46 does not require a pusher 58, an, therefore, is less likely to become entangled in articles of clothing.

After identification and compacting, compacted article 47 is ejected from compacting device 46 to transporter 20. In the illustrated embodiment, transporter 20 is shown as a conveyor 20. In a presently preferred embodiment, conveyor 20 includes a low friction coefficient conveyor belt, such as a polyurethane belt. Alternatively, transporter 20 can consist of robotically controlled arms, a series of bags, attached to a conveyor system, into which each article is placed, or other suitable transport system as will be apparent to those skilled in the art. For example, it is within the contemplation of the present inventors that robotic arms can be mounted on an overhead, circular track. Each arm is provided with a gripper jaw which can pick up a single article of clothing. As the operator identifies the article, the arm moves along the overhead track system to a sort bin associated with the identification information, and drops the garment into the bin. Sufficient arms are mounted on the overhead track to permit an identification approximately every 1.5 s. Alternately, compacting device 46 can consist of a bag or bin that is open at its top end, and can be opened at its bottom end. A series of such bags are mounted along a conveyor. As each article is identified, it falls into a bag, one of which is positioned below conveyor 44 every 1.5 s., and the bag is conveyed away to the identified transfer station 22. When the bag arrives at the transfer station 22, a lever or other opening mechanism opens the bottom end and the article falls into the appropriate sorting bin.

Conveyor 20 under the control of PLC 80, conveys article 47 to transfer stations 22. Conveyor 20 is driven by a drive 86 which is attached to PLC 80. As shown in FIG. 1, transfer stations 22 are arrayed along the length of conveyor 20. Generally, the number of transfer stations 22 will equal the number of sort criteria. A sensor 83, positioned adjacent conveyor 20, measures the length of article 47 after it is ejected from compacting device 46. Sensor 83 transmits this information to PLC 80 which calculates the center of article 47, and determines the distance article 47 must travel to its designated transfer station 22 such that it is centered with respect to transfer station 22.

Figure 6:
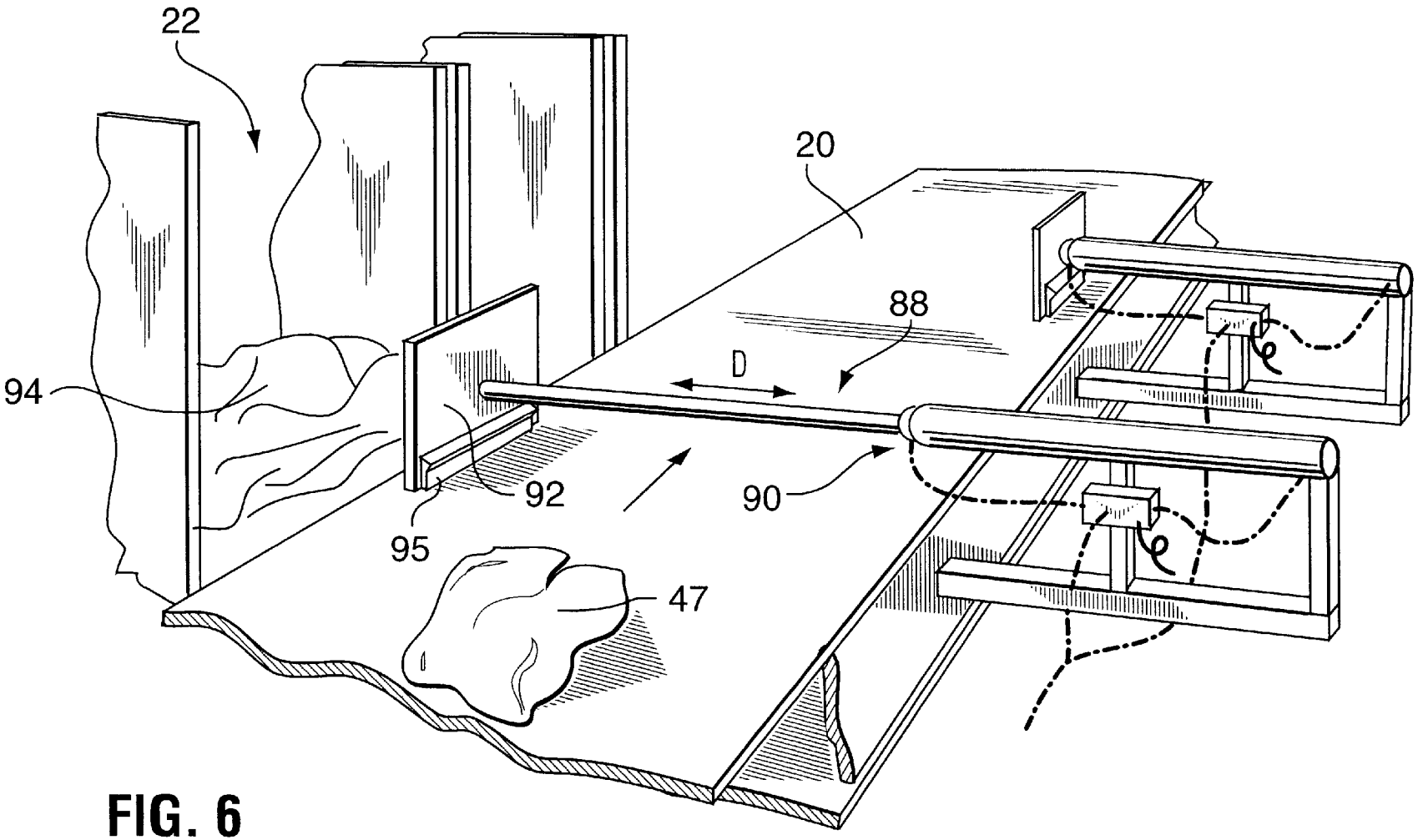
FIG. 6 is a perspective view of a transfer station according to the embodiment of FIG. 1.
Figure 7A:
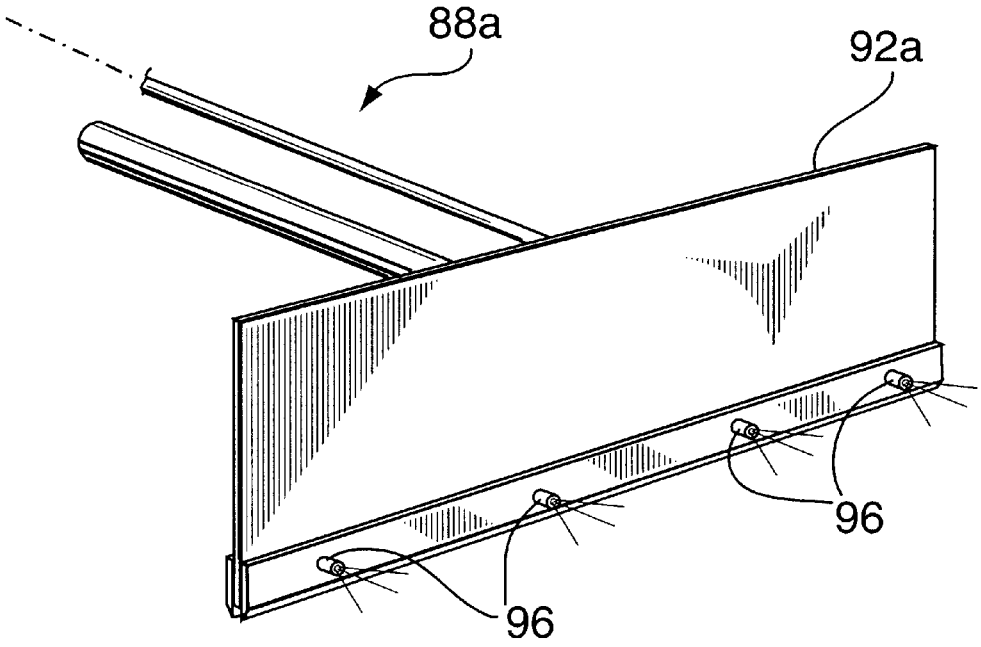
FIG. 7*a* is a perspective view of a further embodiment of a pusher blade according to the present invention, as viewed from the front.
Figure 7B:
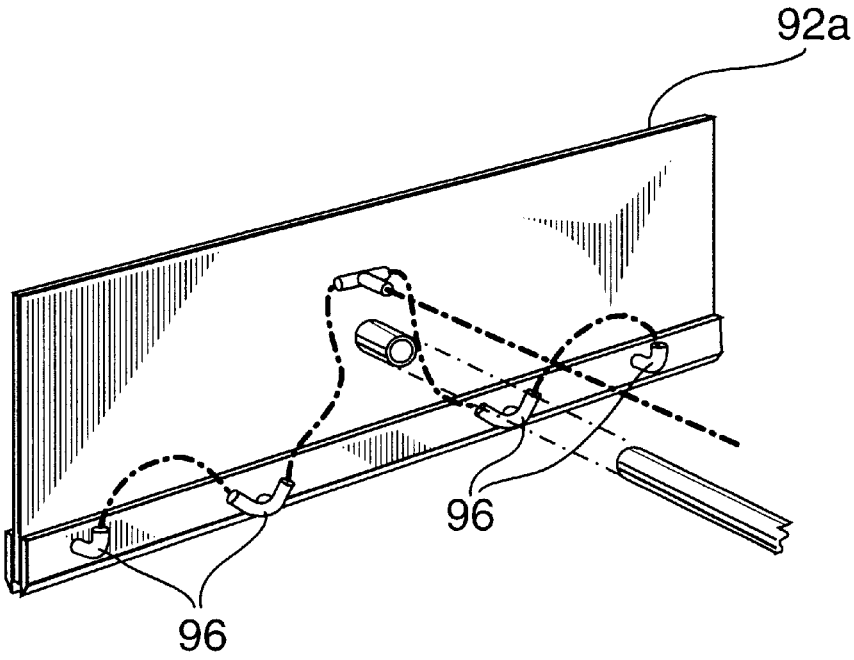
FIG. 7*b* is a perspective view of the pusher blade of FIG. 7*b,* as viewed from the rear.

Referring to FIG. 6, a transfer station 22 is shown. Transfer station 22 consists of a pneumatic transfer arm 88 comprising a conventional pneumatic cylinder 90 propelling a pusher plate 92 as indicated by reciprocating arrow D, and a sorting bin 94. In one embodiment, pusher plate is a substantially solid plate with a rubber wiper blade 95 along its bottom edge. In a second embodiment, as shown in FIGS. 7*a* and 7*b,* air vents 96 are provided along the bottom edge of pusher plate 92*a.* Air is fed to air vents 96 from the pneumatic system, under the control of PLC 80. Pusher plate 92*a* is particularly adapted for transferring very light and/or thin articles, such as silk scarves which are otherwise too insubstantial to be conventionally pushed into sorting bins 94 by blowing a stream of air under the articles to lift them slightly off conveyor 20 as they are pushed off conveyor 20.

In operation, compacted article 47 is conveyed along conveyor 20 until it is positioned at its designated transfer station 22, in accordance with the identification information stored in PLC 80. PLC 80 determines the distance which article 47 must travel along conveyor 20 in order to arrive at its transfer station 22. PLC 80 determines this distance by monitoring drive 86 as it powers conveyor 20. When article 47 is opposite its designated sorting bin 94, transfer arm 88 is actuated and pusher plate 92 pushes article 47 off conveyor 20 and into bin 94. Transfer arm 88 then retracts.

Generally, a plurality of articles 47 will be spread out along conveyor 20, each separated by approximately the distance conveyor 20 travels in 1.5 s., the time taken between selecting articles for identification. The majority of articles 47 will be destined for predetermined transfer stations 22, in accordance with their identification information. PLC 80 stores information concerning the destination of each article 47, and controls the actuation of transfer arms 88 to effect the desired transfer. Articles that have not been identified, or that are not positioned as expected on conveyor 20, fall into reject bin 81 from whence they can be returned to feed bin 40, or manually sorted.

As will be apparent to those of skill in the art, transfer stations 22 do not have to result in article 47 being deposited in a bin 94. It is fully within the contemplation of the present inventors that article 47 can be fed to a secondary automated sort system 10, a manual sorting station, or a further conveyor.

In general, as described above, the method of the present invention consists of separating a compressed bale 30 of non-uniform articles 47 into a stream 32 of articles. The separated articles 47 are fed to an identification station 18, where identification information is associated with each separated article by means of a voice command or keyboard entry. The identified article is then compacted to a predetermined length in a drop box, or by means of an on-off conveyor. The compacted article is then transported to a transfer station 22 determined by the associated identification information. And, finally, the compacted article is transferred at the determined transfer station to a sorting bin or secondary sorting system.

The system and method of the present invention have clear advantages over prior art manual sorting. Using the present system 10, one operator can process up to 1250 lbs/hour of clothing, thereby increasing the efficiency of the operator by up to 300% in a typical work shift. This results in both significant cost savings, and increased productivity for the sorting company. Moreover, an operator is no longer subject to injuries due to repetitively throwing clothing into bins. With the present invention, the operator needs only verbally identify the clothing as it passes, and handling is limited to observing the articles visually, and/or gently manipulating the clothing as it passes along the identification conveyor 44.

It will be apparent to those skilled in the art that the foregoing is by way of example only. Modifications, variations and alterations may be made to the described embodiments without departing from the scope of the invention which is defined solely in the claims.

I claim:

1. A sorting system for sorting non-uniform articles, comprising:

a feed station for supplying a plurality of non-uniform articles;

an identification station wherein identification information is associated with each said article, said identification station including a compacting device for compacting said identified article to a predetermined length;

a transporter for receiving said identified article from said identification station, and for conveying identified articles to one of a plurality of transfer stations;

said plurality of transfer stations dispersed along the length of said transporter, wherein said identification information determines at which of said plurality of transfer stations said identified article is to be transferred, and including means to transfer said identified article.

2. A sorting system according to claim 1, wherein said identification station includes a voice recognition system for receiving a voice command from an operator identifying said article.

3. A sorting system according to claim 1, wherein said identification system includes a gripper for selecting an article for identification.

4. A sorting system according to claim 3, wherein said gripper includes a robotic arm, and a robotic gripper jaw.

5. A sorting system according to claim 4, wherein said identification station includes an identification conveyor onto which said gripper deposits said article.

6. A sorting system according to claim 5, wherein said compacting device includes a box positioned below said identification conveyor, and a pusher for ejecting said article from said box.

7. A sorting system according to claim 1, wherein said transporter includes a conveyor.

8. A sorting system according to claim 7, wherein said transfer means include a pneumatic pusher mechanism.

9. A sorting system according to claim 8, wherein said pusher includes at least one air jet for lifting said identified article from said conveyor.

10. A sorting system according to claim 1, wherein said transfer station transfers said identified article to a secondary sorting system.

11. A sorting system according to claim 1, wherein each said transfer station includes a sorting bin.

12. A sorting system according to claim 1, including a programmable logic controller for receiving and processing said identification information to control transport of said article to said transfer station.

13. A sorting system according to claim 1, wherein said compacting device includes an on-off conveyor.

14. A sorting system according to claim 1, wherein said feed station includes means to separate articles of clothing supplied in compressed bales.

15. A sorting system according to claim 14, wherein said means to separate includes at least one inclined conveyor.

16. A method of sorting soft, non-uniform articles supplied as a compressed bale, comprising the steps of:

(i) separating a compressed bale into a stream of articles;

(ii) feeding the separated articles to an identification station;

(iii) associating identification information with each said separated article;

(iv) compacting the identified article to a predetermined length;

(v) transporting the compacted article to a transfer station determined by the associated identification information; and (vi) transferring the compacted article at the determined transfer station to sort the compacted article.

17. A method according to claim 16, wherein the step of associating includes providing a voice command.

18. A method according to claim 16, wherein the step of separating includes transferring the compressed bale from at least one inclined conveyor.

19. A method according to claim 16, wherein the step of transferring includes pushing the compacted article with a pneumatic pusher from a transport conveyor to a sorting bin.

20. A method according to claim 19, wherein said step of transferring includes providing air jets to lift the compacted article from the transport conveyor.

* * * * *